US005229536A

United States Patent [19]

Kunimoto

[11] Patent Number: 5,229,536

[45] Date of Patent: Jul. 20, 1993

[54] MUSICAL TONE SYNTHESIZING APPARATUS

[75] Inventor: Toshifumi Kunimoto, Hamamatsu, Japan

[73] Assignee: Yamaha Corporation, Hamamatsu, Japan

[21] Appl. No.: 717,385

[22] Filed: Jun. 19, 1991

[30] Foreign Application Priority Data

Jun. 20, 1990 [JP] Japan ..... 2-161863

[51] Int. Cl.[5] ..... G10H 1/06; G10H 5/02

[52] U.S. Cl. ..... 84/658; 84/659; 84/DIG. 9; 84/DIG. 10

[58] Field of Search ..... 84/647, 653, 658, 661, 84/DIG. 9, DIG. 10, 659-660, DIG. 26

[56] References Cited

FOREIGN PATENT DOCUMENTS 248527 12/1987 European Pat. Off. .
6340199 6/1977 Japan .
5858679 2/1988 Japan .

OTHER PUBLICATIONS

Regarding Model of Piano Key Hammer, Nippon Onkyo GAkkai Koenron Bunshu, 327-328, Mar. 1985.

*Primary Examiner*—William M. Shoop, Jr.
*Assistant Examiner*—Brian Sircus
*Attorney, Agent, or Firm*—Graham & James

[57] ABSTRACT

In a musical tone synthesizing apparatus which synthesizes sounds of a non-electronic musical instrument containing a sound-generation element and an activating element, there is provided a loop circuit and an excitation circuit. In case of the piano, the sound-generation element and activating element respectively correspond to its string and hammer. On the basis of the operation of the activating element, the excitation circuit computes a relative displacement between the sound-generation element and activating element. Based on the computed relative displacement and its variation in a lapse of time, repulsion force applied between them is computed under consideration of the elastic characteristic and viscous characteristic of the activating element. Thereafter, the excitation circuit outputs an excitation signal, corresponding to the computed repulsion force, to the loop circuit so as to simulate the sound-generation mechanism of the non-electronic musical instrument.

10 Claims, 3 Drawing Sheets

MUSICAL TONE SYNTHESIZING APPARATUS

BACKGROUND OF THE INVENTION

1. Field of the Invention

The present invention relates to a musical tone synthesizing apparatus which is suitable for synthesizing sounds of a string-striking-type instrument such as a piano.

2. Prior Art

There is a known musical tone synthesizing apparatus which activates a simulation model of a tone-generation mechanism of the non-electronic musical instrument so as to synthesize sounds of the non-electronic musical instrument. This musical tone synthesizing apparatus which synthesizes sounds of the string-striking-type instrument or a string-plucking-type instrument (e.g., guitar) has a known configuration containing a loop circuit and an excitation circuit. Herein, the loop circuit includes a delay circuit which simulates a propagation delay of vibration to be occurred on a string and a filter which simulates an acoustic loss to be occurred on a string. In addition, the excitation circuit produces and outputs an excitation signal to the loop circuit, wherein this excitation signal corresponds to an excitation vibration applied to the string when being plucked or struck. Incidentally, this kind of musical tone synthesizing apparatus is disclosed in the known documents, e.g., Japanese Patent Laid-Open Publication No. 63-40199 and Japanese Patent Publication No. 58-58679.

When synthesizing the piano sound, in order to obtain a natural sound quality, it is necessary to accurately simulate a string-striking mechanism corresponding to an excitation vibration mechanism of the piano. In order to achieve such object, we have proposed a musical tone synthesizing apparatus as disclosed in Japanese Patent Application No. 1-194580. This apparatus is designed to simulate movements of the hammer and the string to be struck based on an initial velocity applied to the hammer, an inertia mass of the hammer and an elastic characteristic of the hammer. Then, the loop circuit inputs the excitation signal corresponding to vibration velocity of the string to be struck by the hammer.

Meanwhile, hammer of the actual piano employs a felt having the elasticity and viscosity. Such viscosity affects motion of the hammer which strikes the string. For example, when the hammer collides with the string at low velocity, the hammer is partially deformed responsive to the collision. In contrast, when the hammer collides with the string at high velocity, the hammer does not follow up with the collision but it acts like a rigid body. Such phenomenon is occurred not only in the piano but also in the other non-electronic musical instruments. For example, in case of the guitar, the excitation vibration mechanism, i.e., a pick, has the viscous characteristic. Conventionally, however, there is no musical tone synthesizing apparatus which is designed under consideration of the viscous effect as described above.

SUMMARY OF THE INVENTION

It is accordingly a primary object of the present invention to provide a musical tone synthesizing apparatus which can simulate motion of the excitation vibration mechanism of the non-electronic musical instrument accompanied with the viscous characteristic.

In an aspect of the present invention, there is provided a musical tone synthesizing apparatus which synthesizes sounds of a non-electronic musical instrument containing a sound-generation element having its specific resonance characteristic and an activating element for imparting an excitation vibration to the sound-generation element, comprising:

loop circuit means containing at least a delay element;

information creating means for creating operation information corresponding to an operation of the activating element; and excitation means for computing a relative displacement between the sound-generation element and activating element based on the operation information, then computing repulsion force applied between the sound-generation element and activating element based on the relative displacement and its variation in a lapse of time, and thereby outputting an excitation signal corresponding to the repulsion force to the loop circuit means.

According the above-mentioned configuration, the repulsion force mutually applied between the sound-generation element and activating element is computed based on the relative displacement between them and its variation in a lapse of time. Then, the excitation signal corresponding to the repulsion force is supplied to the loop circuit means. Then, the excitation signal circulating through the loop circuit means is picked up as a musical tone signal. Thus, it is possible to simulate the operation of the sound-generation element and activating element having the viscous characteristic, by which it is possible to synthesize the musical tone having natural sound effect.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF THE PREFERRED EMBODIMENT

[A] Configuration

Figure 1:
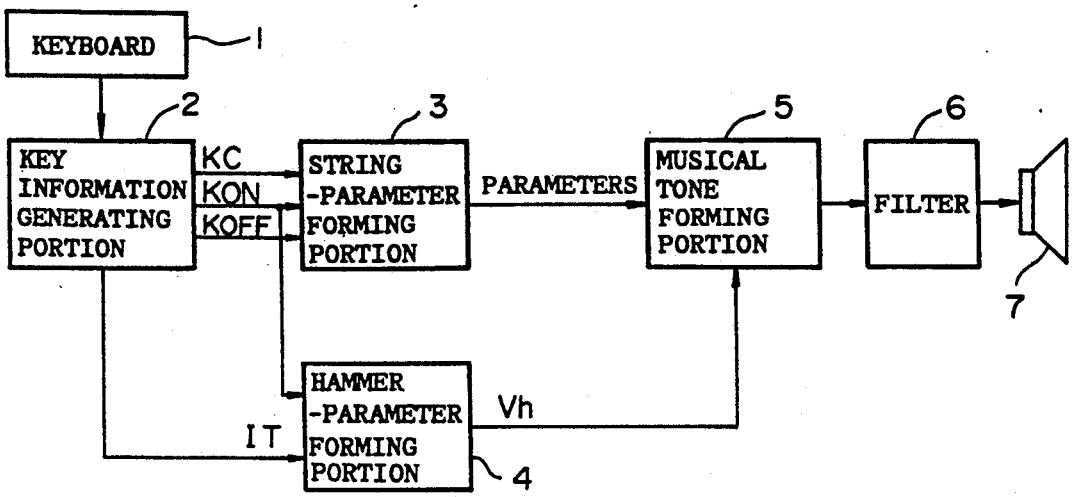
FIG. 1 is a block diagram showing an electric configuration of a musical tone synthesizing apparatus according to an embodiment of the present invention.

Referring now to the drawings, wherein like reference characters designate like or corresponding parts throughout the several views, FIG. 1 is a block diagram showing an electric configuration of a musical tone synthesizing apparatus according to an embodiment of the present invention.

In FIG. 1, 1 designates a keyboard of an electronic musical instrument, and 2 designates a key information generating portion. When a key depression is made in the keyboard 1, the key information generating portion 2 outputs keycode information KC representing the depressed key, a key-on signal KON representing a key-depression event and initial-touch information IT representing key-depression intensity. When the depressed key is released, it outputs a key-off signal KOFF.

Next, 3 designates a string-parameter forming portion which receives the keycode information KC, key-on signal KON and key-off signal KOFF so as to form several kinds of control information in response to the keycode information KC. Incidentally, description of such control information will be given later.

In addition, 4 designates a hammer-parameter forming portion which computes information designating an initial velocity of the hammer corresponding to the initial-touch information IT. When the hammer-parameter forming portion 4 receives the key-on signal KON, it outputs a hammer initial-velocity signal Vh during the predetermined period of time.

Figure 2:
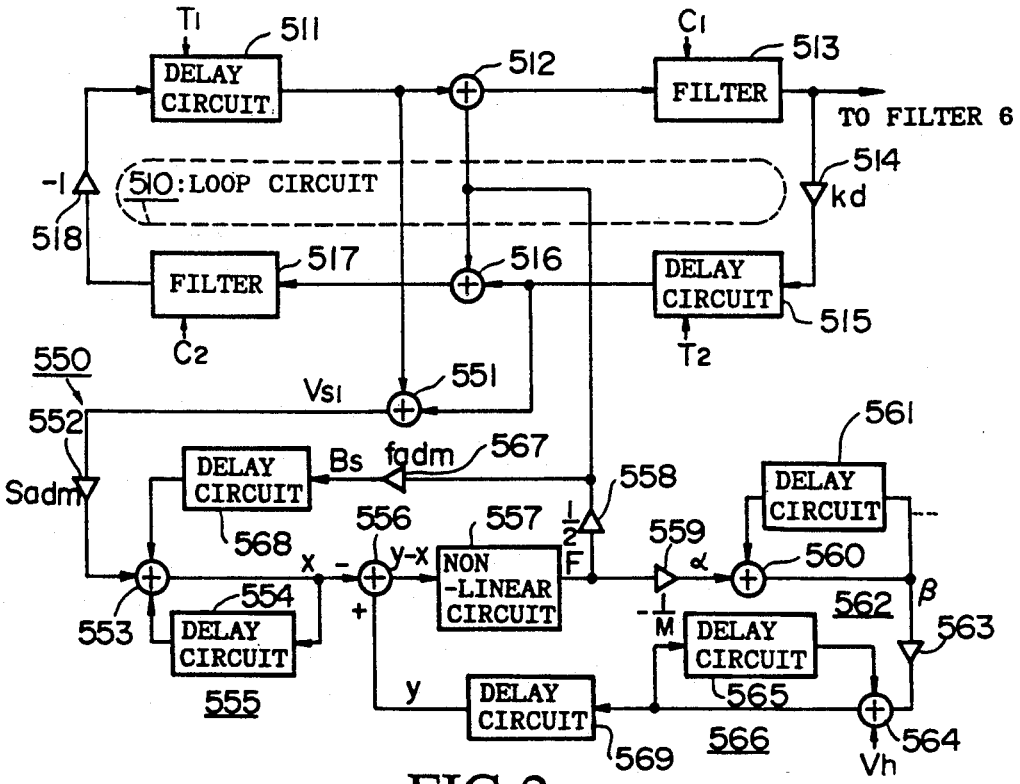
FIG. 2 is a block diagram showing a detailed configuration of a musical tone forming portion shown in FIG. 1.

Next, 5 designates a musical tone forming portion, of which detailed configuration is shown in FIG. 2. In FIG. 2, a loop circuit 510 is provided to simulate the reciprocating propagation of vibration on the string. This loop circuit 510 is configured in form of the closed loop which contains a delay circuit 511, an adder 512, a filter 513, a multiplier 514, a delay circuit 515, an adder 516, a filter 517 and a phase inverter 518.

In the loop circuit 510, each of the delay circuits 511, 515 is configured as a variable delay circuit having a variable delay time which simulates the propagation delay of vibration on the string. The delay times of these delay circuits 511, 515 are respectively controlled by delay information T1, T2 which are formed by the string-parameter forming portion 3. For example, this kind of variable delay circuit can be embodied by a shift register and a selector. Herein, the shift register is designed to delay an input signal, while the selector selectively outputs one of stages outputs of the shift register in accordance with the delay information T1 or T2. Incidentally, the string-parameter forming portion 3 forms the delay information T1, T2 in response to the keycode information KC.

The filters 513, 517 are designed to simulate the acoustic loss of the string. In general, as the frequency becomes higher, the acoustic loss becomes larger. Under consideration of such phenomenon, these filters are designed in form of the low-pass filter. Herein, the string-parameter forming portion 3 forms and delivers filter coefficients C1, C2 to the filters 513, 517 respectively. Based on these coefficients C1, C2, the filters 513, 517 perform the filter operation corresponding to the keycode information KC.

The phase inverter 518 and multiplier 514 are provided to simulate the phase inverting phenomenon which is occurred when string vibration is reflected at both edges of the string. During the tone generation, the string-parameter forming portion 3 supplies a multiplication coefficient kd having a negative value to the multiplier 514. Then, when the key-off signal KOFF is generated in accordance with the key-release event, absolute value of the multiplication coefficient kd is reduced, so that the musical tone is rapidly attenuated.

Next, description will be given with respect to an excitation circuit 550, which is designed to simulate motion of the hammer and string. First, outputs of the delay circuits 511, 515 in the loop circuit 510 are supplied to an adder 551 wherein they are added together so as to generate a string velocity signal Vs1 corresponding to vibration velocity of the string. Then, this string velocity signal Vs1 is multiplied by a multiplication coefficient sadm in a multiplier 552. Incidentally, description of this coefficient sadm will be given later.

Figure 3:
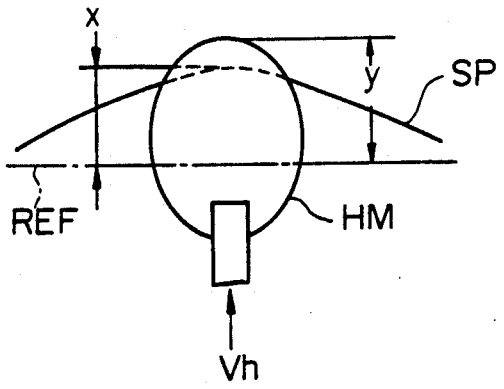
FIG. 3 is a drawing illustrating a relationship between the hammer and string of the piano.

Then, multiplication result "sadm*Vs1" of the multiplier 552 is integrated by an integration circuit 555 which consists of an adder 553 and a one-sample-period delay circuit 554. Thereafter, the integration circuit 555 outputs a string displacement signal "x" which corresponds to displacement of a string SP from a reference line REF shown in FIG. 3. This string displacement signal x is supplied to a first input terminal of a subtractor 556. On the other hand, a hammer displacement signal "y" is supplied to a second input terminal of the subtractor 556. Herein, the hammer displacement signal y corresponding to displacement of a hammer HM (see FIG. 3) is outputted from a delay circuit 569, which description will be given later. Then, the subtractor outputs a relative displacement signal "y-x" corresponding to relative displacement between the hammer HM and string SP.

In the present embodiment, the relative displacement signal "y-x" has a positive value when the string SP partially cuts into the hammer HM, so that repulsion force corresponding to the cut-in amount is imparted between the string SP and hammer HM. On the other hand, when the hammer HM slightly touches the string SP or the hammer HM is positioned apart from the string SP, the relative displacement signal y-x is at zero level or negative level, so that the above-mentioned repulsion force is at zero level.

Next, a non-linear circuit 557 computes the repulsion force which is imparted to the string SP from the hammer HM when the hammer HM collides with the string SP, thus outputting the computation result thereof as a repulsion force signal F. Herein, the repulsion force applied to the string SP from the hammer HM contains two components respectively corresponding to the elastic characteristic and viscous characteristic of the hammer HM. Thus, in the non-linear circuit 557, a first component of the repulsion force corresponding to the elastic characteristic of the hammer HM is computed on the basis of the relative displacement signal y-x, while a second component of the repulsion force corresponding to the viscous characteristic of the hammer HM is computed on the basis of the variation of the relative displacement signal y-x in a lapse of time.

Figure 4:
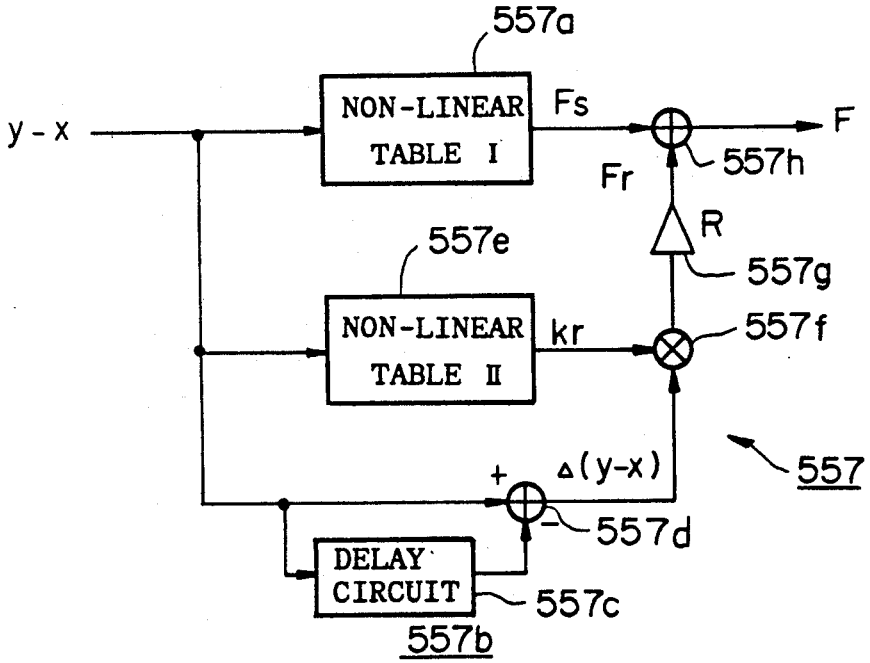
FIG. 4 is a block diagram showing a detailed configuration of a non-linear circuit shown in FIG. 2.
Figure 5A:
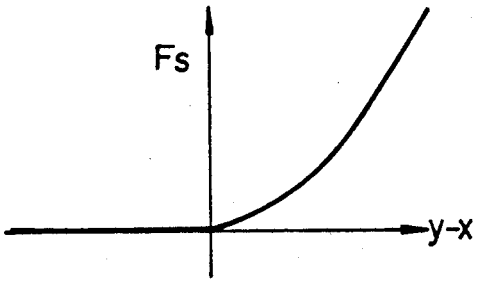
FIGS. 5A, 5B are graphs illustrating non-linear characteristics to be memorized in tables shown in FIG. 4.

FIG. 4 shows a detailed configuration of the non-linear circuit 557. In FIG. 4, non-linear tables **557*a*, 557*e* are each configured in the form of the read-only memory (i.e., ROM). Herein, the ROM 557*a* memorizes a non-linear table I, as shown in FIG. 5A, which simulates the elastic characteristic of the felt of the hammer HM, wherein the relative displacement signal y-x is inputted thereto as the address. It can be easily read from the graph shown in FIG. 5A that as long as the hammer HM is positioned apart from the string SP and the relative displacement signal y-x has a negative value, output of the ROM 557*a* is at zero level. On the other hand, when the hammer HM collides with the string SP so that the relative displacement signal y-x has a positive value, output value of the ROM 557*a* will be raised in response to the increase of the relative displacement signal y-x in accordance with the secondary curve shown in FIG. 5A. Then, output of the ROM 557*a* is supplied to an adder 557*h*** as a first component Fs of the repulsion force signal F corresponding to the elastic characteristic of the hammer HM.

In FIG. 4, 557*b* designates a difference circuit which is provided to detect the variation of the relative displacement signal y-x (i.e., Δ(y-x)) in a lapse of time. This circuit 557*b* consists of a one-sample-period delay circuit 557*c* and a substractor 557*d*, wherein this subtractor 557*d* the delayed output of delay circuit 557*c* from the input signal.

Figure 5B:
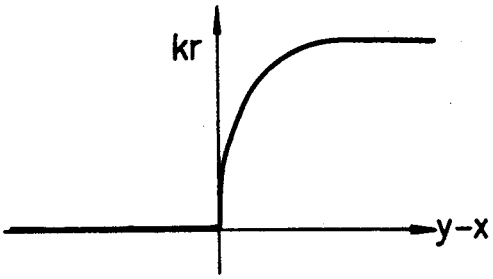

Meanwhile, the ROM 557*e* memorizes another non-linear table II as shown in FIG. 5B, wherein the relative displacement signal y-x is applied thereto as the address. Herein, control information kr corresponding to the relative displacement signal y-x is read from the ROM 557*e*. This control information kr is multiplied by the variation Δ(y-x) of relative displacement in a multiplier 557*f*. Thereafter, multiplication result of the multiplier 557*f* is further multiplied by the predetermined coefficient R in a multiplier 557*g* so as to compute a second component Fr of the repulsion force signal F corresponding to the viscous characteristic of the hammer HM. This second component Fr is supplied to the adder 557*h* wherein it is added with the first component Fs so as to form the repulsion force signal F.

In FIG. 2, the repulsion force signal F outputted from the non-linear circuit 557 is multiplied by "½" in a multiplier 558, which multiplication result is delivered to the adders 512, 516. If necessary, the repulsion force signal F can be multiplied by the coefficient corresponding to the resistance of velocity variation of the string SP so as to compute a factor of the string SP which is imparted to its velocity variation, so that this computed factor is supplied to the loop circuit 510. In contrast, the present embodiment is designed such that the above-mentioned resistance of velocity variation of the string SP can be computed by adjusting the foregoing multiplication coefficient sadm.

In addition, output signal "F/2" of the multiplier 558 is multiplied by a coefficient fadm in a multiplier 567 so as to compute a string velocity signal Bs corresponding to a factor of the velocity variation which is applied to the string SP from the hammer HM. This string velocity signal Bs is delayed by one sample period in a delay circuit 568, which output is supplied to the integration circuit 555. Thus, it is possible to simulate the phenomenon in which displacement of the string SP is occurred when the hammer HM strikes the string SP.

Meanwhile, the repulsion force signal F is supplied to a multiplier 559 to which an inverse value "−1/M" of the inertia mass M of the hammer HM is supplied as the multiplication coefficient. As a result, the multiplier 559 outputs a hammer acceleration signal $\alpha$ corresponding to the acceleration of the hammer HM. This hammer acceleration signal $\alpha$ is subject to the integration operation in an integration circuit 562 consisting of an adder 560 and a delay circuit 561. Thus, the integration circuit 562 outputs a hammer velocity signal $\beta$ corresponding to the velocity variation of the hammer HM. This hammer velocity signal $\beta$ is multiplied by the predetermined attenuation coefficient by a multiplier 563. Then, the attenuated hammer velocity signal and the foregoing hammer initial-velocity signal Vh formed in the hammer-parameter forming portion 4 are supplied to an integration circuit 566 consisting of an adder 564 and a delay circuit 565, so that this integration circuit 566 will output the forgoing hammer displacement signal y.

Thus, output of the filter 513 is supplied to a filter 6 as the musical tone signal corresponding to the direct sound which is directly generated by the string SP to be vibrated. This filter 6 imparts the resonance effect of the acoustic plate of piano to the musical tone signal. Thereafter, the digital musical tone signal outputted from the filter 6 is converted into an analog signal by an digital-to-analog (D/A) converter (not shown), so that a speaker 7 generates the corresponding musical tone.

[B] Operation

Next, description will be given with respect to the operation of the present embodiment. In an initial state where the hammer has not struck the string yet, the hammer HM is positioned apart from the string SP so that the relative displacement signal y-x is at negative level in the musical tone forming portion 5. Thus, it can be easily read from the graphs shown in FIGS. 5A, 5B that both of the outputs Fs and kr of the ROMs 557*a*, 557*e* are at zero level, so that the repulsion force signal F is at zero level. In addition, all of the delay circuits 554, 561, 565, 568, 569 are reset at zero level.

When a key depression is made in the keyboard 1, the key information generating portion 2 outputs the keycode information KC, key-on signal KON and initial-touch information IT in response to the depressed key. Then, the string-parameter forming portion 3 outputs the delay information T1, T2 and filter coefficients C1, C2 in accordance with the keycode information KC, and it also outputs the multiplication coefficient kd having a negative value. These values are set at the corresponding parts in the musical tone forming portion 5. On the other hand, the hammer-parameter forming portion 4 outputs the hammer initial-velocity signal Vh corresponding to the initial-touch information IT, and this signal Vh is continuously supplied to the integration circuit 5 in the musical tone forming portion 5 during the predetermined period of time.

As a result, integration result of the integration circuit 566, i.e., hammer displacement signal y will be varied from negative level to zero level in a lapse of time. During this period, the string displacement signal x is at zero level so that the relative displacement signal y-x is at negative level, which corresponds to the state where the hammer HM is positioned apart from the string SP. Thus, both of the repulsion force signal F and hammer velocity signal $\beta$ are at zero level. Therefore, only the hammer initial-velocity signal Vh is subject to the integration operation in the integration circuit 566.

Thereafter, when the relative displacement signal y-x exceeds over zero level and turns to positive level (which corresponds to the state where the hammer HM collides with the string SP), the ROM 557*a* outputs the first component (i.e., elastic component) Fs of the repulsion force signal corresponding to the relative displacement signal y-x. In addition, the ROM 557*e* outputs the control information kr corresponding to the relative displacement signal y-x, while the difference circuit 557*b* outputs the variation Δ(y-x) of relative displacement. Herein, at an instant where y-x=0, i.e., at an instant when the hammer HM collides with the string SP, it can be easily read from FIG. 5B that kr=0 and the second component (i.e., viscous component) Fr of the repulsion force signal is at zero level. As shown in FIG. 5B, as the relative displacement signal y-x becomes larger, value of the control information kr becomes gradually larger, resulting that the viscous component Fr of the repulsion force signal is gradually increased. When the relative displacement signal y-x reaches certain level, the control information kr is saturated with respect to the relative displacement signal y-x. Thus, the viscous component Fr of the repulsion force signal will be varied in proportional to the variation Δ(y-x) of the relative displacement between the hammer HM and string SP.

Then, the adder 557*h* outputs the repulsion force signal F containing the above-mentioned elastic component Fs and viscous component Fr. This repulsion force signal F is multiplied by the coefficient "−1/M" in the multiplier 559 so as to compute the hammer acceleration signal α having a negative value. Thereafter, this hammer acceleration signal α is subject to the integration operation in the integration circuit 562 so as to compute the hammer velocity signal β. Herein, the hammer velocity signal β has a negative value, therefore, the initial-velocity signal Vh is reduced by the hammer velocity signal β and then subject to the integration operation. Thus, variation of the increase of the hammer displacement signal y will be gradually reduced. Meanwhile, the string velocity signal Bs is created in response to the repulsion force signal F, and it is subject to the integration operation, so that the string displacement signal x will be varied.

During the above-mentioned period, the hammer displacement signal y is increased in positive direction (representing a direction in which the hammer HM depresses the string SP), so that the relative displacement signal y-x is increased and the repulsion force signal F is also increased. When the absolute value of the hammer velocity signal β exceeds over the initial-velocity signal Vh so that moving direction of the hammer HM is turned to a direction in which the hammer HM departs from the string SP, the hammer displacement signal y is varied in negative direction. Then, the relative displacement signal y-x is gradually reduced, while the repulsion force signal F is reduced.

In this case, while the relative displacement signal y-x is larger than certain value, the viscous component Fr of the repulsion force signal F may have a value which is proportional to the variation Δ(y-x) of relative displacement. When the relative displacement signal y-x becomes smaller than certain value, the viscous component Fr is attenuated to a small value. In case of $y-x<0$, i.e., when the hammer HM depart from the string SP, the string-striking operation of the hammer is completed.

As described above, the repulsion force signal F is computed during the string-striking operation. This repulsion force signal F corresponds to a factor of velocity variation by which the hammer HM varies the moving velocity of the string SP. In short, this repulsion force signal F is applied to and circulated through the loop circuit 510 as the excitation signal. Then, the filter 6 imparts the resonance effect to the signal circulating through the loop circuit 510, so that the speaker 7 generates the corresponding musical tone.

Figure 6A:
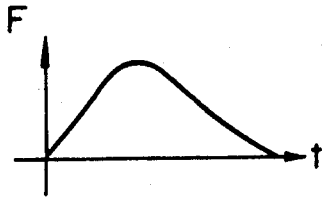
FIGS. 6A, 6B illustrate waveforms which are used to explain an effect of the present invention.
Figure 6B:
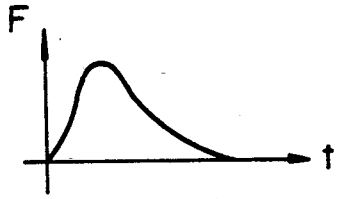

As described heretofore, the present embodiment performs a simulation under consideration of the viscous effect of the hammer HM. Therefore, it is possible to compute the excitation vibration to be applied to the string SP from the hammer HM with accuracy. For example, FIG. 6A shows the waveform of the signal F which is obtained by only using the ROM 557*a* without using the circuit simulating the above-mentioned viscous effect. In this case, the difference circuit 557*b* computes the variation Δ (y-x) of the relative displacement between the hammer HM and string SP, and this variation Δ (y-x) is incorporated in the repulsion force signal F. Thus, it is possible to obtain the waveform of the repulsion force signal F as shown in FIG. 6B which rises up rapidly and contains a plenty of higher harmonic components as comparing to the waveform shown in FIG. 6A.

[C] Modified Example

Figure 7:
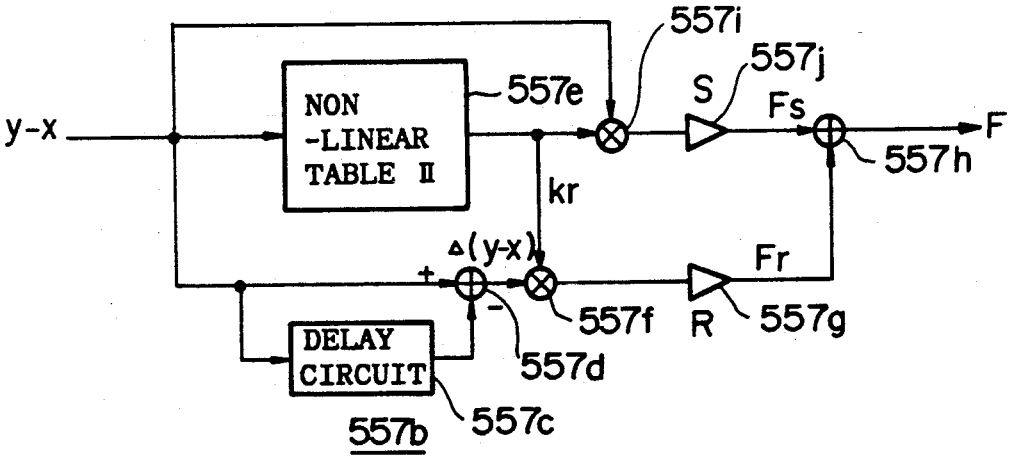
FIG. 7 is a block diagram showing a modified example of the non-linear circuit shown in FIG. 2.

Next, description will be given with respect to a modified example of the non-linear circuit 557 by referring to FIG. 7. In FIG. 7, as comparing to FIG. 4, the relative displacement signal y-x is multiplied by the output of ROM 557*e* (i.e., non-linear table II) in a multiplier 557*i*. Then, multiplication result of the multiplier 557*j* is further multiplied by the predetermined coefficient S in a multiplier 557*j* so as to compute the elastic component Fs of the repulsion force signal. By this circuit, it is possible to approximately embody the contents of non-linear table I as shown in FIG. 5A. Therefore, it is possible to omit the ROM 557*a*.

In the present embodiment described before, the coefficients S, R are provided to determine the ratio between the elastic component and viscous component of the repulsion force signal F. These coefficients can be set by use of a switching control, or they can be set in response to the initial touch and after touch of the key. In addition, the present embodiment employs the ROM memorizing the non-linear table as the non-linear circuit. However, it can be embodied by an operation circuit which performs the predetermined non-linear operation. Further, the delay circuit is not limited to the shift register, but it can be embodied by a random-access memory (i.e., RAM). Furthermore, as the loop circuit containing the delay circuit, it is possible to employ the wave guide as disclosed in Japanese Patent Laid-Open Publication No. 63-40199. Incidentally, the present embodiment is designed to synthesize sounds of the string-striking-type instrument. However, the present invention is not limited to such embodiment, and it is possible to apply the present invention to the other instruments such as the string-plucking-type instrument and wind instrument of which sound-generation mechanism contains the viscous characteristic. In such case, it is possible to obtain the same effect of the present invention. The present embodiment is configured by the digital circuit. However, the present invention can be embodied by the analog circuit. Further, the present invention can be also embodied by use of the digital signal processor (i.e., DSP) wherein the software processing performs the operation of the present invention.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A musical tone synthesizing apparatus which simulates the tone generation mechanism of a non-electronic musical instrument containing a sound-generation element with specific resonance characteristics and an activating element for imparting an excitation vibration to said sound generation element, said musical tone synthesizing apparatus comprising:

loop circuit means for simulating the sound-generation element, said loop circuit means containing at least a delay element;

information creating means for creating operation information corresponding to an operation of said activating element; and excitation means for simulating the interaction of said sound-generation element and said activating element based on said operation information, said excitation means including a non-linear transformation means and an accumulation means, said non-linear transformation means for generating a repulsion force signal representative of a force between said sound-generation element and said activating element, and said accumulation means for accumulating and feeding said repulsion force signal back to said non-linear transformation means, and outputting an excitation signal from said transformation means representative of said repulsion force to said loop circuit means.

2. A musical tone synthesizing apparatus as defined in claim 1 wherein said non-linear transformation means includes a non-linear circuit having a predetermined non-linear characteristic which computes said repulsion force signal based on a temporal variation of said displacement.

3. A musical tone synthesizing apparatus as defined in claim 2 wherein said non-linear table to which the predetermined non-linear characteristic is memorized in advance.

4. A musical tone synthesizing apparatus as defined in claim 2 wherein said non-linear circuit computes first and second components of the repulsion force respectively corresponding to elastic characteristic and viscous characteristic of said activating element so that said first and second components are added together so as to compute said repulsion force.

5. A musical tone synthesizing apparatus as defined in claim 1 wherein said sound-generation element is a string and said activating element is a hammer of a piano.

6. A musical tone synthesizing apparatus as defined in claim 1 wherein said sound-generating element is a string and said activating element is a pick of a guitar.

7. A musical tone synthesizing apparatus as defined in claim 1 wherein said relative displacement variation in a lapse of time corresponds to viscous characteristic of said activating element.

8. A musical tone synthesizing apparatus according to claim 1 wherein said information creating means comprises:

a keyboard having a plurality of keys, key-information generation means for generating key-code information, a key-on signal and initial touch information based on a depressed key;

first parameter generating means for generating first parameters concerning said sound-generation element based on the key-code information and the key-on signal; and second parameter generating means for generating a second parameter concerning said activating element based on the initial-touch information.

9. A musical tone synthesizing apparatus according to claim 8 wherein said loop circuit means simulates the operation of the sound-generation element based on the first parameters, and said operation information is created based on the second parameter.

10. A musical tone synthesizing apparatus comprising:

loop circuit means for generating a musical tone based on an excitation signal, said loop circuit means containing at least a delay element having a delay time which is determined based on a pitch of said musical tone;

feed-back signal generating means including an accumulating means for accumulating said excitation signal, said feed-back signal generating means for generating a feed-back signal based on said accumulated excitation signal, said accumulation operation of said accumulating means being triggered by a triggering instruction which triggers musical tone generation;

mixing means for mixing a signal sampled from said loop circuit means with said feed-back signal;

non-linear transformation means for transforming a mixed output signal of said mixing means to a non-linear output signal according to a predetermined non-linear transfer function; and excitation signal generating means including differentiation means for generating a differentiated signal representative of a time variation of said mixed signal, and said excitation signal generation means for generating an excitation signal based on said differentiated signal.

* * * * *